United States Patent [19]

Pamment

[11] Patent Number: 4,609,117

[45] Date of Patent: Sep. 2, 1986

[54] WASTE CONTAINER

[75] Inventor: Noel G. Pamment, Strathmore, Australia

[73] Assignee: Industrial Containers (Aust.) Pty. Ltd., Australia

[21] Appl. No.: 745,647

[22] Filed: Jun. 17, 1985

[30] Foreign Application Priority Data

Jun. 29, 1984 [AU] Australia ..... PG5763
Feb. 13, 1985 [AU] Australia ..... PG9261

[51] Int. Cl.[4] ..... B65F 1/14
[52] U.S. Cl. ..... 220/1 T; 220/331
[58] Field of Search ..... 220/1 T, 243, 244, 246, 220/249, 314, 331, 213, 313

[56] References Cited

U.S. PATENT DOCUMENTS 2,545,959 3/1951 King ..... 220/331 X
4,152,979 5/1979 Schmidt ..... 220/1 T

FOREIGN PATENT DOCUMENTS 1221959 7/1966 Fed. Rep. of Germany ..... 220/1 T
2754567 6/1979 Fed. Rep. of Germany ..... 220/1 T
2818438 11/1979 Fed. Rep. of Germany ..... 220/331
2833632 2/1980 Fed. Rep. of Germany ..... 220/1 T

*Primary Examiner*—Steven M. Pollard
*Attorney, Agent, or Firm*—James C. Wray

[57] ABSTRACT

A waste container has top opening closed by a lid member. A pair of arms is pivotally mounted on opposed ends of the container. The lid member is pivoted relative to its rear edge to the upper ends of the arms. The arms are of a length and so mounted to the container ends that the lid can be moved between a closed position and an open position with the front edge of the lid sliding along the upper edges of the container ends. A pair of springs connected between each arm and the container assists pivotal movement of the arms relative to the container during sliding movement of the lid across the container opening. When the container is inverted for emptying, the lid pivots relative to the arms to facilitate discharge of waste from the container.

7 Claims, 5 Drawing Figures

WASTE CONTAINER

FIELD OF THE INVENTION

This invention relates to improvements in waste containers and relates particularly to an improved commercial and industrial waste container adapted to be handled by mechanical handling equipment.

BACKGROUND OF THE INVENTION

Large capacity industrial waste containers are commonly used around factories, warehouses, public buildings and other areas requiring waste disposal facilities. The commonly used containers are generally of substantially rectangular configuration with means on either end to enable a specially constructed vehicle to lift the container and dump its contents into the vehicle.

A common size of container provided for general use holds between 1.5 and 5 cubic meters of waste material. Such containers were originally designed with a hinged single closure lid, but because of the weight of the lid and inherent difficulties in opening a lid of such a size, industrial waste containers are now usually provided with two, separately openable, lids adjacent each other.

However, such pair of hinged lids are still relatively heavy and difficult to open and may be dangerous if the lid is not securely held in the open position while the container is being loaded.

BACKGROUND ART

In U.S. Pat. No. 4,456,141 there is described an improved construction of lid for containers which reduces the disadvantages associated with the heavy, standard metal lids. However, as the improved lid is of relatively light construction, it is subject to damage through misuse and incorrect container emptying procedures.

Another form of industrial waste container currently used has an open top defined by the straight, upper edges of the front and rear side walls and by curved upper edges of the end walls. A curved lid is movable between the open and closed positions by being fixed to arms which are pivoted to the end walls at the centre of radius of the curve. The lid is moved, therefore, only by pivotal movement of the arms. This restriction of movement restricts the manner in which the container may be emptied. Mere inversion does not result in opening of the lid and, accordingly, special equipment must be used in conjunction with the mechanical handling vehicles to ensure proper emptying of the container.

One of the difficulties in providing a lid for a waste container is to provide a lid construction such that the lid is relatively easy to open for the insertion of waste material into the container and is relatively easy to close but with the lid construction being sufficiently robust that it is not damaged through mis-use and/or incorrect container emptying procedures. Further, the lid should be constructed to facilitate emptying of the contents by mechanical handling equipment.

Industrial waste, food wastes and numerous other waste materials which are placed in waste containers can attract vermin and insects if the waste material is left exposed. Most constructions of waste containers at present used are provided with lids which do not completely seal the container and some lids are formed with openings at the corners thereof which allow access to the waste within the container thereby also allowing vermin and insects into the container. Such containers are therefore a health risk, particularly when used with food wastes and the like.

It is desirable to provide a lid which, when closed, seals the container against the ingress of vermin, flies and the like, but which will not constitute a danger to users of the container.

It is therefore an object of the present invention to provide an improved form of waste container having a lid which is relatively rigid and sturdy and which is relatively easy to open to enable the container to be loaded, and which can be used in association with mechanical handling equipment so that the contents of the container are easily dumped into a waste disposal vehicle.

SUMMARY OF THE INVENTION

According to one aspect of the invention there is provided a waste container having at least a partially open top defining a container opening, a lid adapted to close the container opening, a pair of arms extending upwardly from pivotal connections on opposite ends of the container, means for pivotally connecting a rear edge portion of said lid to said arms whereby the lid can pivot relative to the arms, and the arms being so located that pivotal movement thereof about their pivotal connection to the container ends causes the rear edge portion of the lid to be raised relative to the container opening to permit the lid to move rearwardly across the container opening.

Preferably, the means for pivotally connecting the rear edge portion of the lid to the arms comprises sleeve members on the rear edge portion of the lid engaged with a bar integral with each of the pair of arms. In one embodiment, the integral pair of arms and bar are formed from tubular metal bent so as to extend across the top of the container and downwardly on each end to be pivotally connected to the opposite ends of the container.

It is also preferred that counter balance means be connected to the arms to assist in the opening and closing movement of the lid across the container opening. Such counter balance means may comprise two pairs of compression springs, one pair acting on each of the arms, and arranged to counter balance the weight of the arms and lid on each side of a mid-opening position of the lid.

In the preferred form of the invention, the lid member is curved, preferably part cylindrical, and is adapted to close the container opening which is defined by the upper front edge of the container, curved upper edges of the container sides and the edge of a rear fixed upper panel extending across a portion of the top of the container. The front edge of the lid is preferably formed of a strip of rubber or synthetic plastic material which seals against the upper front edge of the container. The strip of rubber or synthetic plastic material has a width such that, when the lid is in the closed position, the metal front edge of the lid is spaced from the metal upper edge of the container.

The waste container of the present invention is easily used by a sliding, rearward movement to obtain access to the container opening. The pair of arms act to lift the rear edge of the lid member over the front edge of the fixed upper panel during the initial opening movement.

When the container is to be emptied, mechanized equipment is able to invert the container, using appropriate fitments on the container ends, and the lid member pivots to an open position relative to the arms in view of its pivotal connection thereto.

In the preferred form of the invention, the waste container is of rectangular box shape, and a further feature of the invention is the formation of the front and rear lower edges of the container by downwardly and inwardly sloping floor sections to provide cut-away corner edges. Castors are mounted to brackets fixed in the cut-away space so that the castors are located substantially within the plan outline of the container. This arrangement lowers the centre of gravity of the container relative to the castors thus providing a container which is more stable than the normal containers where castors are simply mounted to the base thereof. Further, as the castors do not project from the sides of the container, the container is easily moved into relatively narrow or confined spaces.

In order that the invention is more readily understood, one embodiment thereof will now be described with reference to the accompanhing drawings.

DESCRIPTION OF THE PREFERRED EMBODIMENT

Figure 1:
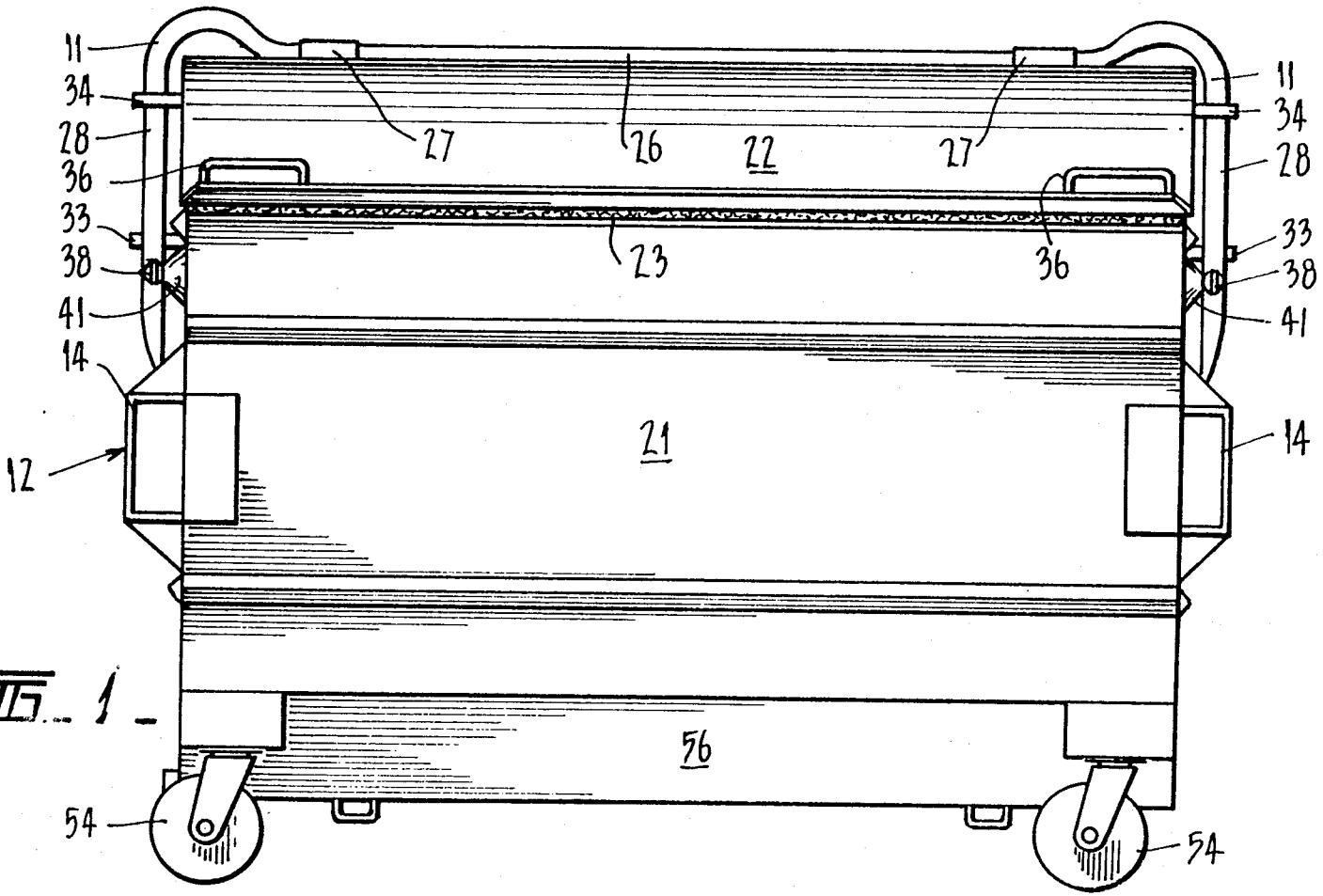
FIG. 1 is a front elevational view of a container constructed in accordance with the invention.
Figure 2:
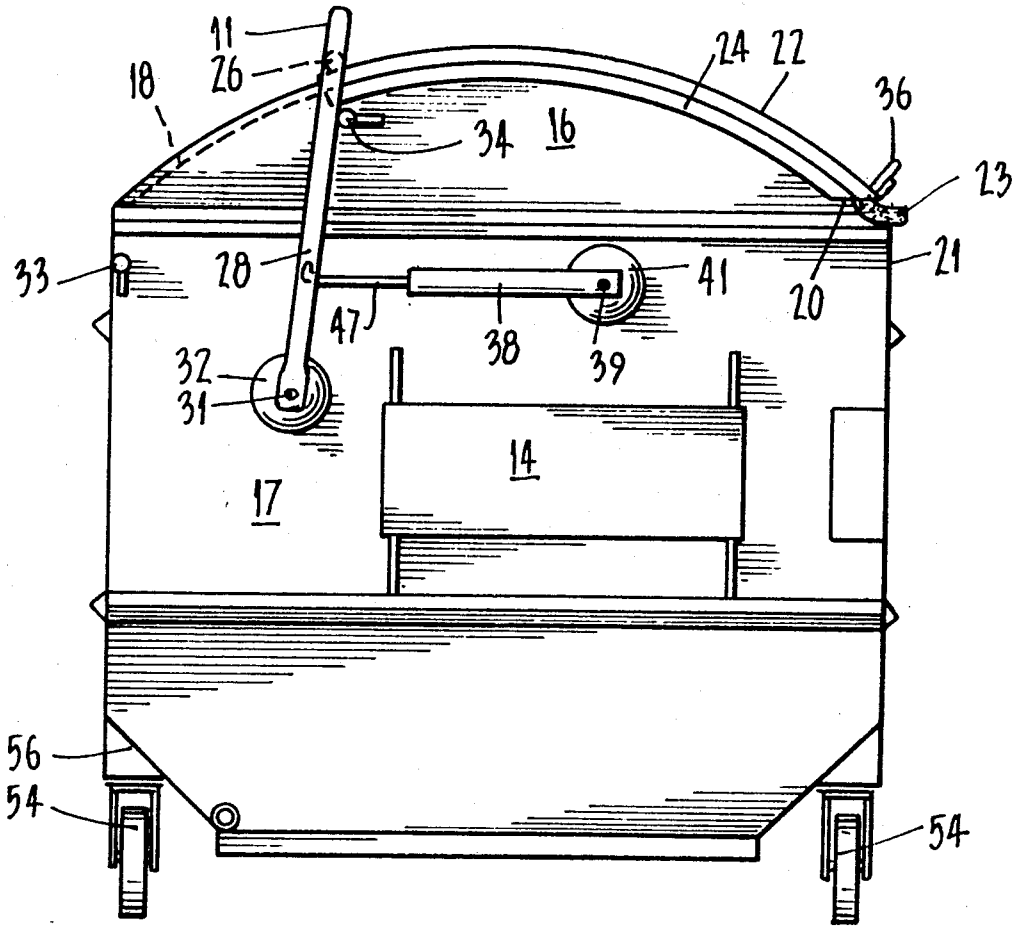
FIG. 2 is a side elevational view of the container of FIG. 1 with the lid in the closed position.

Referring to the drawings, the container 12 may be of any desired shape although the invention is described with reference to an industrial waste container of substantially box-shape and having lifting sockets 14 at each side of the container 12 to enable mechanized equipment to lift and empty the container by inversion.

The ends 17 of the container have curved upper edges 16, preferably arcuate, and the top of the container is open except for a rear portion which is closed by a fixed panel 18. Thus, the opening through which material is inserted and removed from the container is defined by the upper edges 16 of the ends 17, the front edge of the fixed rear panel 18 and the upper edge of the front panel 21 of the container.

The container lid comprises a lid member 22 having a curved or arcuate shape corresponding to the shape of the upper edges 16 of the container ends 17. The front edge 20 of the lid member 22 is constituted by a rubber or synthetic plastic strip 23, preferably a reinforced rubber strip. The strip is fastened to the front edge 20 of the curved lid member and is adapted to seal against the upper edge of the front panel 21 when the lid is in the closed position. The width of the rubber strip 23 is such that the front edge 20 of the curved portion of the lid 22 is spaced from the upper edge of the front panel 21 to thereby prevent fingers of people using the container being jammed between the metal parts.

Curved flanges 24 extend along the curved edges of the lid 22 and act to guide movement of the lid and to seal the lid against the container ends 17.

A rod or tube may be fixed to each side of the front edge 20 of the container lid member 22 to provide minimal surface area of engagement between the lid and side edge during opening movement of the lid, the rod or tube riding along the side edges during such movement.

The lid 22 is pivoted adjacent its rear edge to a support bar 26, preferably formed of a tubular metal and bent so as to have a shape as illustrated in FIG. 1 with downwardly extending portions thereof constituting arm portions 28, the ends of which are pivotally connected to the ends 17 of the container 12. The pivotal connection of the lid 22 to the support bar 26 is by means of a pair of sleeves 27 which are located on the support bar 26 prior to final bending thereof, the sleeves being subsequently secured to the lid 22, preferably by welding.

The arm portions 28 of the support bar 26 are flattened at their free ends 29 and are each connected by a pivot bolt 31 to a frusto-conically shaped plate 32 which is welded around its base to the respective container ends 17. The upper ends of the arm portions 28 have a relatively smooth curved shape which ensures that the support bar 26 has proper clearance along the curved edges of the ends 17 whilst maintaining maximum strength of the tubular material from which the support bar 26 is constructed. The upwardly curved portions 11 of the support bar 26 immediately adjacent the sleeves 27 prevent the lid 22 moving along the support bar 26 during pivotal movement thereof. Thus the lid is maintained in alignment with the side edges.

A stop 33 is fitted on each container end 17 to restrict rearward pivotal movement of the support bar 26 about the pivot bolts 31. A second stop 34 is mounted on each container end 17 adjacent the curved edge 16 to restrict the forward pivotal movement of the support bar 26.

The location of the frusto-conical plate 32 carrying the pivot bolt 31 on each container end 17 is determined so that, when the lid member 22 is in the closed position, the arm portions 28 extend upwardly and forwardly. The length of the arm portions 28 and the angle thereof is arranged so that, on initial rearward movement of the lid member 22 relative to the container 12, the resultant pivotal movement of the support bar 26 about the pivot bolts 31 causes the rear edge of the lid member 22 to be raised relative to the rear panel 18. Thus, the lid member 22 is opened by a rearward sliding movement which lifts the rear portion of the lid 22 over the rear panel 18 and the side edges of the lid 22, particularly at the front end thereof, slide along the upper curved edges 16 of the container ends 17. It has been found that relatively little friction occurs but, if desired, nylon, metal or other glides may be used, either on the lid member 22 or on the curved, upper edges 16 of the container ends 17, to reduce friction.

It will be seen that if the opening provided by the sliding movement of the lid to the open position as described above is insufficient to enable large articles to be loaded through the container opening, the lid member 22 may be pivoted upwardly relative to the support bar 26 to provide greater accessibility to the container. A pair of handles 36 are provided on the lid member to facilitate the opening thereof.

Figure 5:
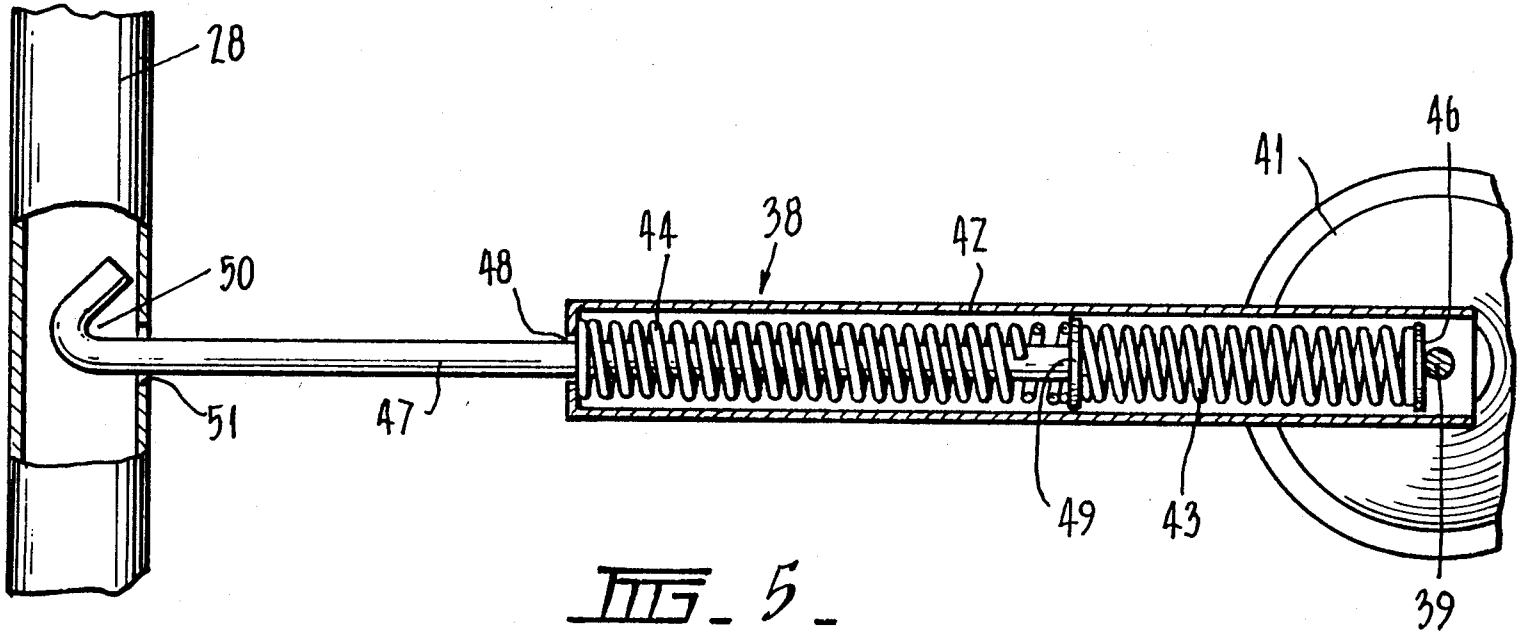
FIG. 5 is a detail view of the counter balance.

Opening and closing of the lid member 22 is also facilitated by a pair of counter balance assemblies 38 as illustrated in FIG. 5. An assembly 38 is mounted on each end 17 of the container by means of a pivot 39 fixed to a frusto-conical plate 41. Each assembly 38 comprises a tube 42 housing a pair of compression springs 43 and 44. A disc 46 is located adjacent the pivot 39 to support one end of the spring 43. An operating rod 47 extends through a hole 48 in the closed end of the tube 42, the rod being provided with a disc 49 which provides an abutment for the other end of the spring 43 and one end of the spring 44, the other end of which abuts against the closed end of the tube 42.

The free end of the rod 47 is bent at 50 to an angle greater than 90°, and is located through a hole 51 in the arm portion 28 of the support bar 26. The hole 51 is of a dimension to prevent withdrawal of the rod 47 without disconnecting the assembly 38 from the container end 17.

Figure 3:
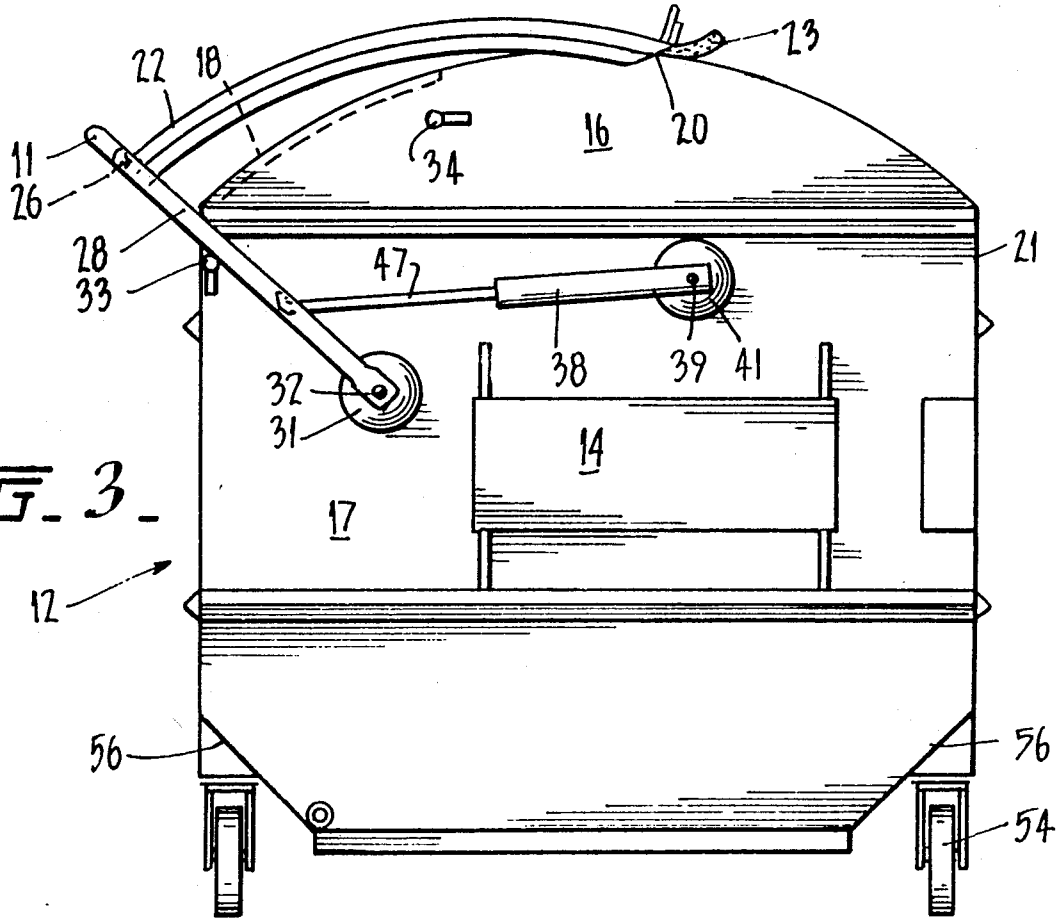
FIG. 3 is a view similar to FIG. 2 but with the lid in the open position.

The compression spring 44 has a greater or stronger rate than the spring 43 so as to provide greater assistance to movement of the lid 22 in one direction as compared to movement in the other direction. When the lid is in the closed position as shown in FIG. 3, the compression spring 43 is compressed so that that spring will assist in initial opening movement of the lid 22. As the lid moves past a midpoint or balance point of its movement, the spring 44 becomes compressed thus balancing the weight of the lid in its open position and providing assistance for closing the container lid.

Figure 4:
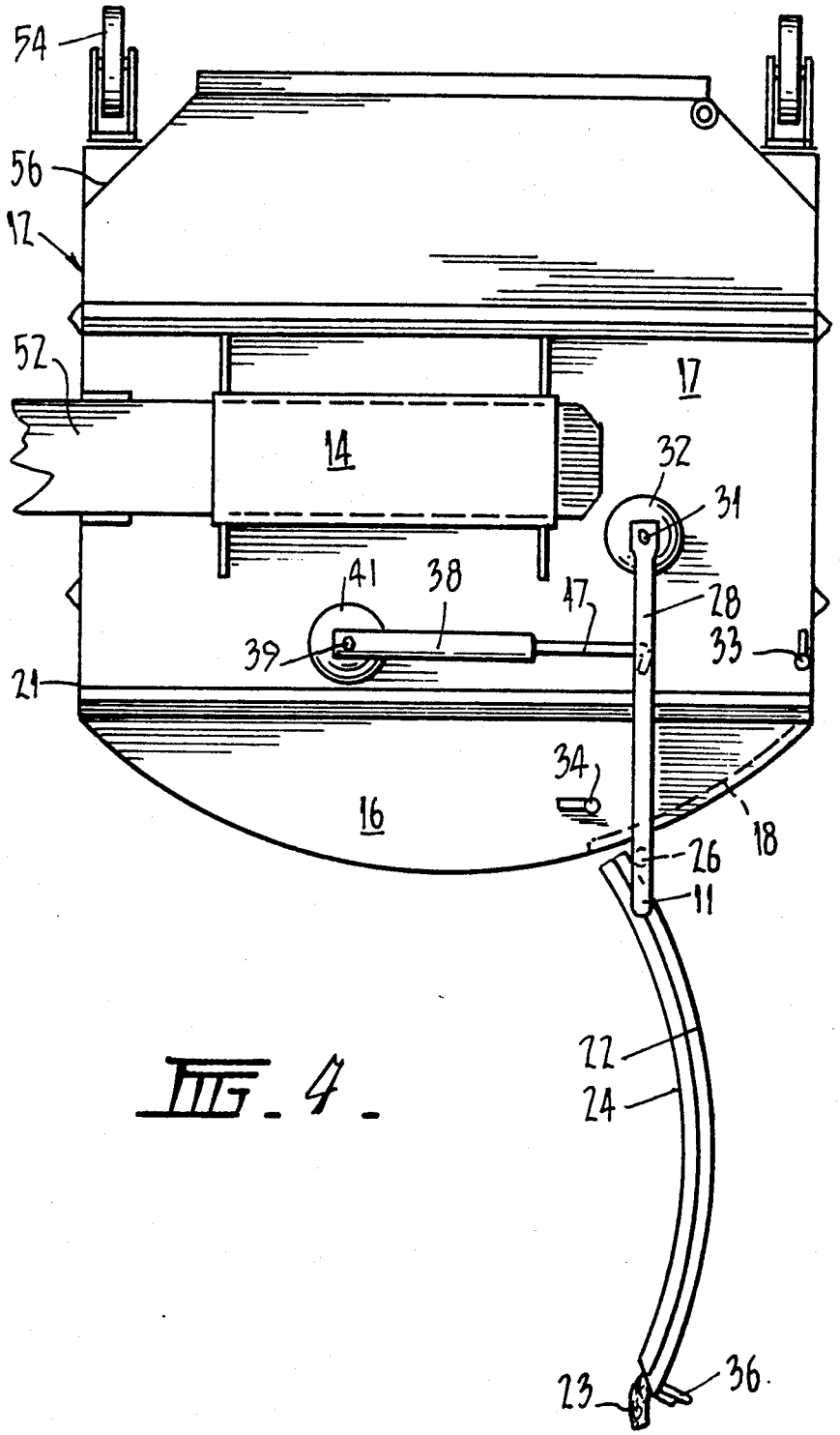
FIG. 4 is a view showing the container in an inverted position as during emptying.

When the container is to be emptied, a pair of forks 52 from mechanical handling apparatus engage the lifting sockets 14 to lift and invert the container over a waste disposal vehicle. The inversion of the container 12 results in the lid member 22 pivoting on the sleeves 27 about the support bar 26 to an open position as shown in FIG. 4 whereby the container contents are emptied into the waste disposal vehicle. The pivotal mounting of the support bar 26 may also assist in providing adequate opening or movement of the lid in the open position.

The waste container of the invention is preferably mounted on castors 54, as is common practice in the art. However, with the container of the present invention, the lower front and rear portions of the container, or, alternatively, opposed lower side portions, are cut away so that the castors can be located within the cut away areas. Thus, as shown in FIG. 5, the lower front and rear portions of the container 12 are provided with angularly extending floor sections 56 which provides clearance for location of the castors 54 on brackets 57 welded to the floor sections 56. Sufficient clearance is provided to enable the castors to rotate about their vertical axes. The location of the castors in the cut away sections lowers the centre of gravity of the container and provides for greater stability in movement of the container, particularly over rough surfaces.

Although the embodiment described has shown a fixed rear panel 18, it will be appreciated that such a panel may be hinged to the rear panel of the container to provide additional loading and/or emptying access. The fixed panel would normally cover no more than approximately 30% of the top of the container 12, although it will be appreciated that the fixed panel may be of any desired dimension commensurate with container use.

I claim:

1. A waste container having a pair of arms extending upwardly from pivotal connections on opposed container end walls, each pivotal connection comprising a frusto-conical mounting member fixed to the respective end wall and a pivot stud extending from the frustum surface of the mounting member to receive the respective arm so that it is spaced from the container end wall, hinge means pivotally connecting upper ends of the arms to a rear edge of a curved lid which closes at least two thirds of the area forming the container opening as defined by the upper curved edges of the end walls and upper edges of front and rear walls, a rear closure panel closing the remaining rear portion of the container opening, the length of the arms and location of the mounting members therefore being so arranged that the rear edge of the lid is raised relative to a front edge of the rear closure panel to permit the lid to be pivoted rearwardly about the pivot studs, guide means on the front, outer edges of the lid which engage and slide along the curved upper edges of the end walls during opening and closing movement of the lid, stop means on the container end walls to limit relative pivotal movement of the arms, and biasing means on each end of the container, each said biasing means comprising a pair of compression springs disposed end to end in a housing pivoted at one end to a respective end wall, an operating rod extending through an opening in the other end of the housing and pivotally connected to a respective arm, and abutment means connected to the operating rod and disposed between the adjacent ends of the compression springs.

2. A waste container according to claim 1, wherein the means for pivotally connecting the rear edge of the lid to the arms comprises sleeve means on the rear edge, said sleeve means engaged with a bar integral with each of the pair of arms.

3. A waste container according to claim 2, wherein the integral bar and arms are formed of tubular metal bent so as to extend across the top of the container and downwardly on each end.

4. A waste container according to claim 1, wherein the rear closure panel is fixed to the upper edge of the rear wall.

5. A waste container according to claim 1, wherein said lid is part cylindrical.

6. A waste container according to claim 1, wherein a front edge of the lid comprises a strip of rubber or plastic material.

7. A waste container according to claim 1, wherein opposed lower front and rear, or side, portions of the container are formed with floor sections extending angularly between the respective front and rear, or side, walls and a bottom wall of the container, the angularly extending floor sections defining spaces to receive castors mounted to brackets located in the spaces whereby the castors do not extend beyond the front, rear and end walls of the container.

* * * * *